US009670669B2

(12) United States Patent
Gosling et al.

(10) Patent No.: US 9,670,669 B2
(45) Date of Patent: Jun. 6, 2017

(54) MODULAR BUILDING CONSTRUCTION SYSTEM

(71) Applicant: Dirtt Environmental Solutions, Ltd., Calgary (CA)

(72) Inventors: Geoff Gosling, Calgary (CA); Mogens Smed, DeWinton (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 0 days.

(21) Appl. No.: 14/009,728

(22) PCT Filed: Jun. 6, 2013

(86) PCT No.: PCT/US2013/044524
§ 371 (c)(1),
(2) Date: Oct. 3, 2013

(87) PCT Pub. No.: WO2013/188211
PCT Pub. Date: Dec. 19, 2013

(65) Prior Publication Data

US 2015/0300008 A1 Oct. 22, 2015

Related U.S. Application Data

(60) Provisional application No. 61/658,403, filed on Jun. 11, 2012.

(51) Int. Cl.
*E04B 2/72* (2006.01)
*E04B 1/14* (2006.01)
(Continued)

(52) U.S. Cl.
CPC ..... *E04B 2/721* (2013.01); *E04B 1/14* (2013.01); *E04B 1/40* (2013.01); *E04B 1/6125* (2013.01);
(Continued)

(58) Field of Classification Search
CPC .... E04B 2/721; E04B 1/40; E04B 2002/7462; E04B 1/14; E04B 1/6125; E04B 1/6145;
(Continued)

(56) References Cited

U.S. PATENT DOCUMENTS 2,757,116 A * 7/1956 Clements ..... E04C 2/292 156/182
3,037,590 A * 6/1962 Pavlecka ..... E04C 2/08 52/275
(Continued)

FOREIGN PATENT DOCUMENTS

JP 06049931 2/1994
JP 0624078 8/1994
(Continued)

OTHER PUBLICATIONS

International Search Report and Written Opinion for PCT/US2013/044524 mailed Jun. 6, 2013.
(Continued)

*Primary Examiner* — James Ference
(74) *Attorney, Agent, or Firm* — Workman Nydegger

(57) ABSTRACT

Implementations of the present invention relate to systems, methods, and apparatus for constructing a building. More specifically, the present disclosure provides an interlocking wall system that can allow a builder to accurately position, orient, and/or secure various structural wall modules. Additionally, this disclosure provides systems and methods for securing one or more cladding layers to the building's envelope. Furthermore, implementations of the present disclosure can allow for quick and modifiable installation of utility and communication lines within the building.

20 Claims, 7 Drawing Sheets

(51) Int. Cl.

| | |
|---|---|
| ***E04C 2/288*** | (2006.01) |
| ***E04F 13/08*** | (2006.01) |
| ***E04B 1/41*** | (2006.01) |
| ***E04C 2/34*** | (2006.01) |
| ***E04B 2/00*** | (2006.01) |
| ***E04B 1/61*** | (2006.01) |

(52) U.S. Cl.
CPC ..... *E04B 1/6145* (2013.01); *E04C 2/288* (2013.01); *E04C 2/34* (2013.01); *E04C 2/46* (2013.01); *E04F 13/081* (2013.01); *E04F 13/0816* (2013.01)

(58) Field of Classification Search
CPC ... E04C 2/46; E04C 2/34; E04C 2/288; E04C 2/7425; E04C 2/296; E04C 2/049; E04C 2/205; E04C 2/22; E04F 13/0816; E04F 13/081
USPC ..... 52/586.1, 281, 239, 481.1, 794.1, 489.1, 52/506.05, 220.2
See application file for complete search history.

(56) References Cited

U.S. PATENT DOCUMENTS 3,529,389 A * 9/1970 Wilkins ..... E04B 1/6125 174/497
3,686,810 A * 8/1972 Allen ..... E04B 2/78 52/243
4,336,675 A * 6/1982 Pereira ..... E04B 2/64 52/267
4,545,168 A * 10/1985 Dalton, Jr. ..... E04B 1/6108 52/239
5,038,539 A * 8/1991 Kelley ..... A47B 21/06 211/190
5,097,643 A * 3/1992 Wittler ..... E04B 2/7425 160/135
5,222,902 A * 6/1993 Piersch ..... A63H 33/062 403/345
5,305,567 A * 4/1994 Wittler ..... E04B 2/7425 160/135
5,353,562 A * 10/1994 Decker ..... E04C 2/205 256/31
5,466,086 A * 11/1995 Goto ..... E04B 1/2604 403/267
5,735,090 A * 4/1998 Papke ..... E02D 27/00 52/220.2
6,044,609 A * 4/2000 Kim ..... E04F 13/0864 52/478
6,134,852 A * 10/2000 Shipman ..... A47B 57/425 52/220.7
6,235,367 B1 * 5/2001 Holmes ..... E04B 1/14 428/223
6,240,691 B1 * 6/2001 Holzkaemper ..... E04B 1/942 52/309.8
6,308,491 B1 10/2001 Porter
6,430,885 B1 * 8/2002 Ito ..... E04F 13/0812 52/235
6,484,465 B2 * 11/2002 Higgins ..... E04F 13/083 52/235
6,631,589 B1 * 10/2003 Friedman ..... B66B 11/0226 187/401
6,647,562 B1 * 11/2003 Arout ..... E04H 4/0043 4/506
6,679,021 B2 * 1/2004 Maimon ..... E04C 2/296 52/271
6,860,073 B2 * 3/2005 Chien ..... E04C 2/521 52/220.1
6,968,661 B2 * 11/2005 Kopish ..... E04B 2/7457 52/481.1
6,973,756 B2 * 12/2005 Hatzinikolas ..... E04F 13/0855 52/235
7,165,767 B2 * 1/2007 Graef ..... G07D 11/0003 109/24.1
8,161,697 B1 * 4/2012 McDonald ..... E04C 2/16 428/106
2003/0033769 A1 * 2/2003 Record ..... E04B 1/14 52/270
2003/0110726 A1 6/2003 Rudduck
2005/0229528 A1 * 10/2005 Kardosz ..... E04C 3/11 52/639
2006/0230700 A1 * 10/2006 Chen ..... E04C 2/20 52/586.1
2007/0044411 A1 * 3/2007 Meredith ..... E04B 1/14 52/586.1
2007/0175158 A1 * 8/2007 Cope ..... E04B 1/2604 52/585.1
2007/0194672 A1 * 8/2007 Hibicke ..... H02B 7/08 312/223.1
2007/0251181 A1 * 11/2007 Dupont ..... E04F 13/0805 52/586.1
2008/0134610 A1 * 6/2008 Jakob-Bamberg .... E04B 2/7448 52/489.1
2008/0302037 A1 * 12/2008 Brown ..... E04B 5/12 52/289
2009/0064627 A1 * 3/2009 Struthers ..... H02G 1/00 52/714
2009/0193735 A1 * 8/2009 Kalinowski ..... E04B 2/60 52/281
2009/0251035 A1 * 10/2009 Cash ..... A47B 47/042 312/265.5
2010/0018146 A1 * 1/2010 Aube ..... E02D 29/0233 52/483.1
2010/0074683 A1 * 3/2010 Richard ..... E04B 1/486 403/408.1
2011/0173925 A1 * 7/2011 Brown ..... E04B 1/14 52/794.1
2011/0290307 A1 * 12/2011 Workman ..... F24J 2/5211 136/251

FOREIGN PATENT DOCUMENTS

JP 0718936 7/1995
JP 200012980 5/2000

OTHER PUBLICATIONS

European Search Report for application No. 13803755 mailed on Mar. 6, 2016.

* cited by examiner

MODULAR BUILDING CONSTRUCTION SYSTEM

CROSS-REFERENCE TO RELATED APPLICATIONS

The present invention is a 35 U.S.C. §371 U.S. National Stage of PCT Patent Application No. PCT/US2013/044524 filed Jun. 6, 2013, entitled "Modular Building Construction Systems and Methods," which claims the benefit of priority to U.S. Provisional Patent Application No. 61/658,403, filed Jun. 11, 2012, entitled "Modular Building Construction Systems And Methods." The entire content of each of the aforementioned patent applications is incorporated herein by this reference.

BACKGROUND OF THE INVENTION

1. The Field of the Invention

This invention relates to systems, methods, and apparatus for securing trim to interior and exterior portions and walls of a building as well as for aligning and securing together the building's walls.

2. Background and Relevant Art

A typical building construction involves preparing and constructing walls as well as other building elements at a build site. Additionally or alternatively, a builder may choose to use prefabricated wall modules to construct interior and/or exterior walls of the building. Oftentimes, varying levels of worker's skills can result in inconsistent build quality. Furthermore, human error also can affect the quality of construction. For instance, workers can position and/or secure wall modules incorrectly, thereby increasing the amount of finishing work on the building and/or necessitating further modifications to the building.

Once the structural portions of the walls are constructed (i.e., a building envelope is formed), a typical building may incorporate additional features on the walls. For example, the builder may add a cladding layer to the outer surfaces of the building's walls for improved aesthetic appearance as well as weather protection. Similarly, the builder can add a cladding layer to the interior surfaces of the walls. Adding the cladding layer can present particular challenges in construction projects utilizing modular walls, such as structural insulated panels (SIPs) and insulated concrete forms (ICFs), and can be time-consuming and expensive.

Additionally, a typical building includes various utilities and communications, such as plumbing and sewer lines, electrical lines, data and communication lines, etc. Thus, after constructing the building envelope, the builder may have to furnish the building with necessary utilities. Incorporating various utilities in the building usually presents numerous challenges. For instance, housing utility lines within permanent walls may require modifications and/or partial demolition of already constructed portions of the building envelope, which may be time-consuming and expensive to perform. For example, running electrical, plumbing or other utilities through the SIP panels is time consuming and challenging. The use of ICFs requires careful forethought and placement of utility raceways or connectors, as once the concrete is set it is difficult or impossible to access the wall cavity. Even typical stud framed walls cannot be easily accessed once the drywall is applied, without damaging or replacing the drywall.

Accordingly, there are a number of disadvantages in systems and methods for constructing a building that can be addressed.

BRIEF SUMMARY OF THE INVENTION

Implementations of the present invention provide systems, methods, and apparatus for constructing a building. More specifically, in at least one implementation, an interlocking wall system can allow a builder to accurately position and/or secure various structural wall modules. For instance, the builder can position and/or secure structural portions of the building's walls (i.e., structural wall modules), thereby forming a building envelope. The interlocking wall system also can prevent and/or reduce incidents of human error, which can increase accuracy of the constructed building envelope and can reduce time required to complete such construction.

At least one implementation includes an interlocking modular wall system for constructing a building envelope. The interlocking wall system has a first structural wall module including a first interlock positioned at an offset from one or more of a vertical centerline or a horizontal centerline of the first structural wall module. The interlocking wall system also has a second structural wall module including a second interlock positioned at an offset from one or more of a vertical centerline or a horizontal centerline of the second structural wall module. Additionally, the first interlock is connectable with the second interlock, and when connected together, the first and second interlocks orient and position the first structural wall module relative to the second structural wall module.

Implementations also include a quick-connect wall cladding system for providing one or more of improved aesthetic and protection to an exterior wall of a building. The quick-connect wall cladding system includes a structural wall module that has an exterior face that is configured to form at least a portion of the exterior wall of the building. Additionally, the quick-connect wall cladding system includes a plurality of wall-side connectors secured to or incorporated with the structural wall module. The quick-connect wall cladding system includes a cladding layer sized and configured to provide an improved aesthetic and/or protection to the exterior face of the structural wall module. Moreover, the quick-connect wall cladding system has a plurality of cladding-side connectors secured to or incorporated into the cladding layer. The plurality of wall-side connectors and the plurality of cladding-side connectors are connectable together to secure the cladding layer to the structural wall module.

Additional or alternative implementations include an interlocking modular wall system for constructing a building envelope. The interlocking modular wall system has a first structural wall module that includes one or more first interlocking features and one or more first wall-side connectors. The interlocking modular wall system also has a second structural wall module that includes one or more second interlocking features and one or more second wall-side connectors, the one or more second interlocking features being connected to the one or more first interlocking features. Furthermore, the interlocking modular wall system has one or more cladding layers that include cladding-side connectors that are secured thereto or integrated therewith. Also, the cladding-side connectors are connected to one or more of the one or more first wall-side connectors and the one or more second wall side connectors.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
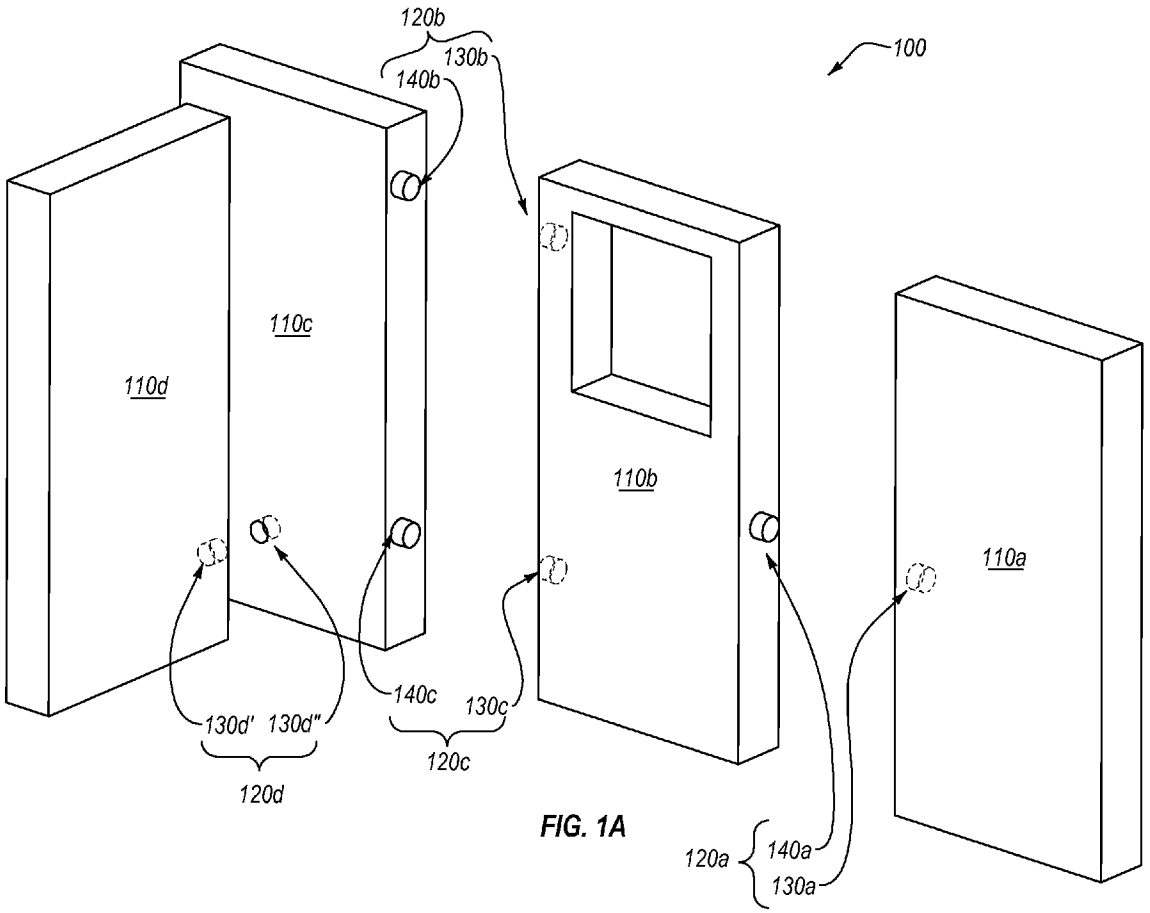
FIG. 1A illustrates a perspective view of a disassembled interlocking modular wall system in accordance with one implementation of the present invention.

Implementations of the present invention provide systems, methods, and apparatus for constructing a building. More specifically, in at least one implementation, an interlocking wall system can allow a builder to accurately position and/or secure various structural wall modules. For instance, the builder can position and/or secure structural portions of the building's walls (i.e., structural wall modules), thereby forming a building envelope. The interlocking wall system also can prevent and/or reduce incidents of human error, which can increase accuracy of the constructed building envelope and can reduce time required to complete such construction.

Additional implementations provide for the separation of the cladding or finish materials from the envelope building materials. For example, one or more implementations include exterior and/or interior curtain walls. Such curtain walls may comprise an under-structure that can connect to the wall per the constraints of the building material of the wall, while providing a consistent surface that will accept virtually any finish or finish material.

Still further implementations provide a building envelope (i.e., outer walls) and modular interior walls. The modular interior walls comprise horizontal and vertical frame members to which wall cladding (such as decorative tiles) attach. The building envelope can be devoid of utilities (plumbing, HVAC, electrical, etc.) or have only entry or exit points. The modular interior walls can house the utilities. The ability to easily remove or install the wall cladding on the modular interior walls can facilitate easy access to the utilities. For example, utilities can enter through a basement and extend up into the interior walls. In such implementations, utilities need not penetrate the exterior above-ground walls.

One or more implementations also include a quick-connect cladding systems, which can allow the builder to position and secure various cladding layers to the modular walls of a building structure to form curtain walls. For example, the builder can secure one or more cladding layers to the interior portion of the building's walls using connectors and receivers of the quick-connect cladding system. Similarly, the builder also can secure cladding layers to the exterior of the building's envelope. Furthermore, a manufacturer can prefabricate structural wall modules, such as SIP and/or ICF wall modules, which can incorporate connectors or the quick-connect cladding system, and which can couple to receivers secured to or integrated with the cladding layers. Thus, the builder can secure the cladding layers to the exterior portion of the building envelope, thereby forming the quick-connect cladding system.

Additionally, the interlocking wall system and the quick-connect cladding system together can improve alignment and positioning of the cladding layers. In particular, the manufacturer can prefabricate structural wall modules that incorporate portions of the interlocking wall system as well as portions of the quick-connect cladding system (e.g., connectors). Accordingly, the builder can connect the structural wall modules at predetermined positions, to form the building envelope that also has connectors of the quick connect cladding system at predetermined positions. Thus, the builder can connect the cladding layers to the structural wall modules at predetermined positions, which can allow the builder or an architect to incorporate a consistent and/or matching pattern across the cladding layer.

At least one implementation also includes a modular utility wall system, which can house one or more utility and/or communication lines, such as plumbing, sewer, HVAC ducts, electrical lines, data lines, communication lines, etc., and combinations thereof. In particular, the modular utility wall system can allow the builder to avoid including utility and/or communication lines in the building envelope (i.e., outer walls of a building). For instance, the builder can provide the utility and or communication lines through the modular utility wall system, which can comprise a plurality of modular inner walls. Thus, the builder can avoid modifying the structural walls and/or structural wall modules of the building envelope. Furthermore, the modular utility wall system also can allow the builder to reposition the utility and/or communication lines as well as to provide access to these lines for inspection and/or repair thereof.

Figure 1B:
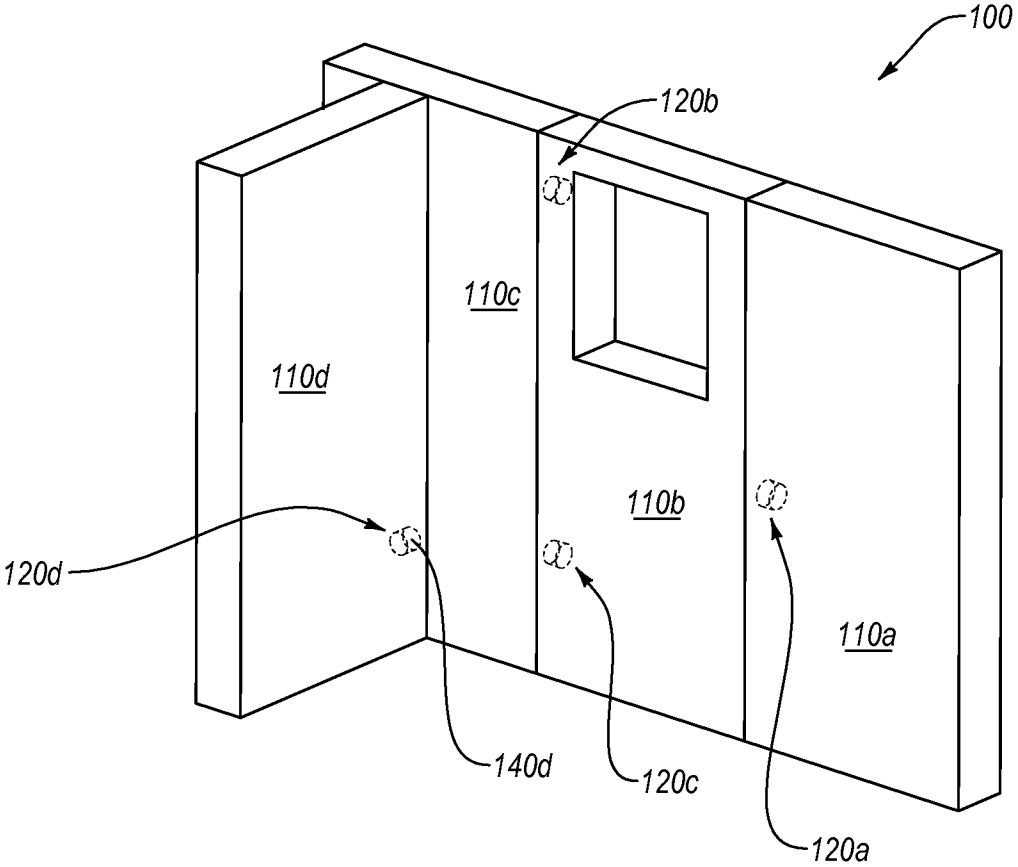
FIG. 1B illustrates a perspective view of an assembled interlocking modular wall system of FIG. 1A.

Accordingly, the builder can reduce construction time and increase quality of the build by using the interlocking wall system, which can force the builder to position and/or secure structural wall modules at predetermined positions. For instance, as illustrated in FIGS. 1A and 1B, an interlocking modular wall system 100 can include multiple structural wall modules (e.g., structural wall modules 110*a*, 110*b*, 110*c*, 110*d*) and one or more matching interlocks that can align and/or connect adjacent wall modules. Specifically, FIG. 1A illustrates the interlocking modular wall system 100 before assembly, while FIG. 1B illustrates an assembled interlocking modular wall system 100. In one example, the interlocking modular wall system 100 can include matching interlocks 120*a* that can align the structural wall module 110*a* and structural wall module 110*b*. Similarly, matching interlocks 120*b*, 120*c* can align adjacent structural wall modules 110*b*, 110*c*, and the matching interlocks 120*d* can align structural wall modules 110*c*, 110*d*.

In at least one implementation, the matching interlocks 120*a*, 120*b*, 120*c*, 120*d* can include a female interlock and a male interlock, such as the female interlocks 130*a*, 130*b*, 130*c* and the male interlocks 140*a*, 140*b*, 140*c*. The male interlocks 140*a*, 140*b*, 140*c* can fit into corresponding female interlocks 130*a*, 130*b*, 130*c*, thereby positioning and orienting adjacent ones of structural wall modules 110*a*, 110*b*, 110*c* relative to each other. For instance, female interlock 130*a* can accept the male interlock 140*a*, thereby positioning and orienting the structural wall module 110*a* with respect to the structural wall module 110*b*.

In additional or alternative implementations, the matching interlocks can include two female interlocks that may accept a connecting or aligning member therebetween. In one example, the matching interlocks 120*d* may include a female interlock 130*d*' and another, opposing female interlock 130*d*". The builder can insert an alignment member 140*d* into one or both of the female interlocks 130*d*', 130" to align and/or connect the female interlocks 130*d*', 130*d*" together. For instance, to align the structural wall modules 110*c*, 110*d*, the builder can insert the alignment member 140*d* into the female interlock 130*d*', such that the alignment member 140*d* protrudes out of the female interlock 130*d*' and can enter the female interlock 130*d*" when the builder presses together the structural wall modules 110*c* and 110*d*.

The structural wall modules can include any suitable number of matching interlocks on any side thereof. In one example, the structural wall modules can have a single matching interlock pair, such as the matching interlocks 120*a*, which can align the structural wall modules 110*a*, 110*b*. In additional or alternative implementations, multiple interlock pairs can align adjacent structural wall modules. For example, two matching interlocks 120*b*, 120*c* can align structural wall modules 110*b*, 110*c*. In particular, female interlocks 130*b*, 130*c* can accept corresponding male interlocks 140*b*, 140*c*, thereby positioning and orienting the structural wall module 110*b* with respect to the structural wall module 110*c*.

It should be appreciated, however, that any side (i.e., left and right sides, top and bottom, and front and back) of any structural wall module may include any suitable number and combination of male and/or female interlocks. For instance, the structural wall module 110*b* can have male interlock 140*a* on a first side, and female interlocks 130*b*, 130*c* on a second side. Accordingly, a builder can fit the male interlocks 140*a*, 140*b*, 140*c* into the corresponding female interlocks 130*a*, 130*b*, 130*c*, to position and orient the structural wall module 110*b* with respect to the structural wall modules 110*a*, 110*c*.

In one or more implementations, the structural wall modules 110*a*, 110*b*, 110*c*, 110*d* also can have portions of the matching interlocks positioned on a bottom side, a top side, and/or one or more faces of the structural wall module 110. For instance, the matching interlocks can orient and position any of the structural wall modules 110*a*, 110*b*, 110*c*, 110*d* relative to a base (not shown). In one example, the structural wall modules can incorporate the male and/or female interlocks on the bottom sides thereof, and the base can incorporate corresponding female and/or male interlocks that couple with the male and/or female interlocks on the bottom sides of the structural wall modules, thereby aligning the structural wall modules relative to the base.

In one implementation, the interlocking modular wall system 100 can include the matching interlocks between a face of one structural wall module and a side of another structural wall module. Hence, in some instances, the matching interlocks can facilitate angular alignment between adjacent structural wall modules (e.g., the installer can form a T or L configuration). For example, the builder can position and connect together the structural wall modules 110*c*, 110*d* at a ninety-degree angle (i.e., in a T or L configuration).

As mentioned above, the structural wall module 110*c* can include the male interlocks 140*b*, 140*c* on a first side and a female interlock 130*d*" on a front thereof. The builder can connect the structural wall module 110*d* to the front of the structural wall module 110*c*, aligning the structural wall modules 110*c*, 110*d* with matching interlocks 130*d*', 130*d*". Also, the first side of the structural wall module 110*c* can connect to the second side of the structural wall module 110*b*. Accordingly, the matching interlocks can orient and position multiple structural wall modules, one with respect to another, in various combinations, which can include structural wall modules positioned in-line as well as structural wall modules positioned at various angles with respect to each other. Furthermore, including different interlocks on different sides of the structural wall modules can force the installer to position the structural wall module in a predetermine configuration relative to each other.

In at least one implementation, the manufacturer can position the matching interlocks such that the builder can connect the structural wall modules one to another in a predetermined manner. More specifically, in order to couple the corresponding portions of the matching interlocks (e.g., the female and male interlocks) located on respective structural wall modules, the builder can position the structural wall modules only in a predetermined manner. In other words, particular arrangement or positioning and/or male-female combinations of the interlocks on the structural wall modules can provide for predetermined positioning and orientation of adjacent structural wall modules aligned by such matching interlocks.

For instance, in the example illustrated in FIGS. 1A-1B, the structural wall module 110*b* includes a male interlock 140*a* on a first side. As such, the installer may be forced to connect the right side of the structural wall module 110*b* to the structural wall module 110*a*, which includes a corresponding female interlock 130*a* that can accept the male interlock 140*a*. Similarly, the structural wall module 110*b* can include the female interlocks 130*b*, 130*c* on a second side, which can force the installer to connect the second side of the structural wall module 110*b* to the structural wall module 110*c* that has corresponding male interlocks 140*b*, 140*c*.

Additionally or alternatively, the structural wall modules can have offset matching interlocks, such that the builder can connect the matching interlocks 120 one to another only in a predetermined manner. As such, the builder may be forced to connect the structural wall modules in a predetermined orientation. For instance, adjacent structural wall modules may include two side matching interlocks positioned at different distances from top and bottom of the structural wall modules. Consequently, positioning one of such structural wall modules upside-down (i.e., top side on the base) can position the matching interlocks out of alignment with each other, which can prevent connecting the structural wall modules together.

The example in FIGS. 1A-1B shows that the distance from the top side of the structural wall module 110*b* to the female interlock 130*b* can be different than the distance from the bottom side of the structural wall module 110*b* to the female interlock 130*c*. Likewise, the structural wall module 110*c* can have similar or the same positioning of the corresponding male interlocks 140*b*, 140*c* from the top and bottom sides thereof. Thus, the builder can align and connect together the structural wall modules 110*b*, 110*c*, as shown in FIG. 1B.

In addition, some implementations can include matching interlocks positioned at a distance from the front surface of the structural wall module that is different than the distance from back surface. In other words, the structural wall module can include matching interlocks offset from a centerline of the structural wall module. Accordingly, if the builder positions one of adjacent structural wall modules in a flipped orientation, for instance, such that the top side of the flipped structural wall module faces downward, the corresponding portions of the matching interlocks on the adjacent structural wall modules may not align with and each other. Similarly, if rotated (e.g., 180°), such that the front face of one structural wall module is aligned with the back face of the adjacent structural wall module, the corresponding portions of the matching interlocks may not align with and each other and may prevent the builder from making such incorrect connection.

Thus, the matching interlocks can force the builder to orient the structural wall modules in a predetermined orientation. More specifically, the builder may have to align the corresponding portions of the matching interlocks on adjacent structural wall modules in order to connect together such structural wall modules. Notably, the structural wall modules can incorporate portions of the matching interlocks offset from various surfaces and/or sides thereof, such as to force the builder to orient the structural wall modules at a predetermined orientation.

Moreover, the structural wall modules can incorporate portions of the matching interlocks that have different shapes and/or sizes. For instance, the structural wall module can incorporate portions of cylindrical matching interlocks on a first side thereof, and portions of rectangular matching interlocks on a second side thereof. Accordingly, the builder may have to position the structural wall module such that the portions of the cylindrical and rectangular matching interlocks align with the corresponding portions of the cylindrical and rectangular matching interlocks. Therefore, the manufacturer or the architect can incorporate matching interlocks into two or more structural wall modules of the interlocking modular wall system 100, to ensure accurate positioning and orientation of the structural wall modules. Furthermore, such matching interlocks can ensure proper positioning of two structural wall modules of the interlocking modular wall system 100 as well as any number of the structural wall modules, including all of the structural wall modules in the interlocking wall system.

Figure 2:
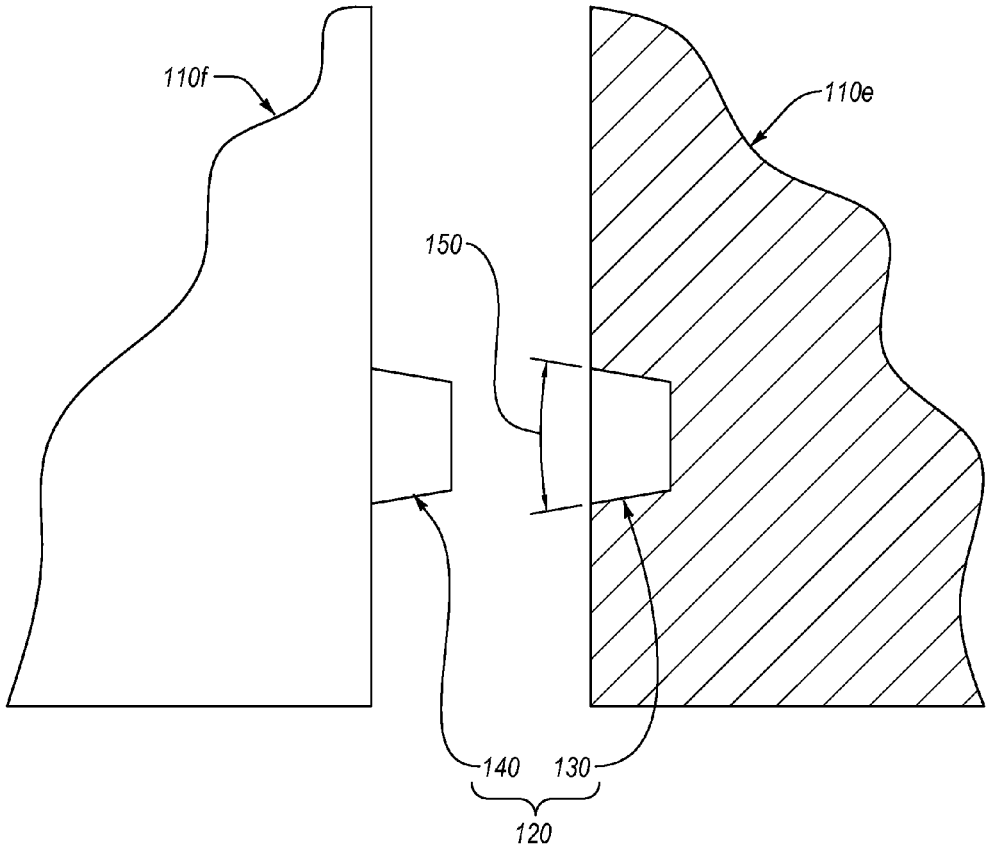
FIG. 2 illustrates a cross-sectional view of matching interlocks in accordance with one implementation of the present invention.

As described above, in at least one implementation, the matching interlocks can have two portions comprising the male and female interlocks. FIG. 2 illustrates an enlarged partial cross-sectional view of an exemplary matching interlock 120. It should be appreciated that any of the matching interlocks 120*a*, 120*b*, 120*c*, 120*d* (FIGS. 1A-1B) and their respective materials, elements, or components may be similar to or the same as the matching interlock 120 and its materials, elements and components.

In one or more implementations, the matching interlock 120 includes a female interlock 130 and a male interlock 140. The female interlock 130 may form a recess and a portion of a structural wall module 110*e*, which can receive the male interlock 140 that can protrude from a portion of a structural wall module 110*f*. Furthermore, the female interlock 130 can have sufficient clearance to facilitate entry of the male interlock 140 as well as to locate the corresponding structural wall modules. For instance, female and male interlocks 130, 140 can include 0.020" per side clearance therebetween.

As such, the female and male interlocks 130, 140 may have limited or no freedom of motion relative to each other in at least a two-dimensional plane. In other words, the female and male interlocks 130, 140 may connect together in a manner that the female and male interlocks 130, 140 cannot move along at least two axes. Accordingly, the matching interlocks 120 can orient and position adjacent structural wall modules 110*e*, 110*f* along at least two axis (e.g., a first axis that may be perpendicular to front and back surfaces of the structural wall modules and along a second axis that may be perpendicular to left and right sides of the structural wall modules).

In light of this disclosure, those skilled in the art should appreciate that matching interlocks can have other configurations. For instance, as mentioned above, the matching interlocks can comprise two female interlocks and a dowel therebetween. More specifically, a first structural wall module can include a first female interlock recessed therein, and a second structural wall module can include a second female interlock recessed therein. The builder can insert the dowel into the first and the second female interlocks, thereby positioning and orienting the respective first and second structural wall modules. It should be noted that, the female interlocks and the corresponding dowels can have various shapes (e.g., the female interlocks can have rectangular shapes that can accommodate a rectangular dowel, such as a piece of dimensional lumber, circular shapes that can accommodate a round or tubular dowel, such as a pipe, and others).

Furthermore, in one or more implementations, the matching interlocks 120 also can couple or secure the structural wall modules together. For example, the female and male interlocks 130, 140 can have corresponding locking tapers. More specifically, the female and male interlocks 130, 140 can incorporate an included angle 150. For instance, an included angle 150 can be 3°. Accordingly, the female and male interlocks 130, 140 can couple and lock together on the locking taper, thereby securing the respective structural wall modules 110*e*, 110*f*.

Additionally or alternatively, portions of the matching interlocks can have an interference fit one with another to secure the respective structural wall modules together. Moreover, the matching interlocks can incorporate various features that can allow portions of the matching interlocks located on adjacent structural wall modules to couple one to another, thereby securing the adjacent matching interlocks one to another. For instance, portions of the matching interlocks can have snap-fit features, that snap together to secure the corresponding portion of the matching interlocks.

A builder can employ any number of suitable mechanisms to temporarily and/or permanently secure structural wall modules together. Moreover, in addition to or in lieu of connection features described above, the structural wall modules can have other features and/or elements that can secure one structural wall module to another. For example, the structural wall modules can include retention mechanisms more fully described in U.S. Pat. No. 7,832,154, entitled "Position Retention Mechanism for Modular Wall Assembly," and in U.S. Pat. No. 7,984,598, entitled "Position Retention Mechanism for Modular Wall Assembly," the entire contents of which are incorporated herein by reference. The structural wall modules can include such retention mechanisms in lieu of or in addition to matching interlocks.

In at least one implementation, the structural wall modules can include prefabricated wall modules such as wall modules comprising SIP and/or ICF walls. The manufacturer can place window and/or door openings as well as other components in the structural wall modules at the factory. The manufacturer also can attach matching interlocks to the structural wall modules.

In addition, the structural wall modules can include matching interlocks that interface with non-structural wall modules (e.g., divider walls inside the building envelope). Hence, the manufacturer also can include corresponding portions of the matching interlocks on the non-structural wall modules, which the manufacturer can provide at the build site. As such, the manufacturer can ensure that the builder properly positions and orients the non-structural wall modules relative to the structural wall modules as well as relative to one another. In any case, the manufacturer can use the matching interlocks to ensure that a worker cannot flip, rotate, or otherwise change the orientation and/or order of various wall modules. Thus, the matching interlocks can help ensure that a desired design is followed at the construction site.

In addition to ensuring proper orientation and order of structural and/or non-structural wall modules, the matching interlocks can also ensure that the wall modules are properly aligned. For example, the positioning of the matching interlocks can ensure that the outer surfaces of adjacent wall modules are flush and aligned. This can reduce the need to patch or otherwise fix misalignment of wall modules using time consuming techniques.

The matching interlocks also are optionally independent from any bridging components (such as a beam above and/or below) or additive assumptive methods (such as all panels held sequentially in place, assumed to be immovable because of the ending condition of the entire run) to structurally connect adjacent panels. The forcing functions and specific matching interlocks can be specific to the building materials used for the building envelope. In other words, implementations can include structural wall modules that have matching interlocks that can facilitate alignment and/or positioning of other building elements connected to or interfacing with the building envelope, such as cladding layers, utility lines, and the like.

Figure 3:
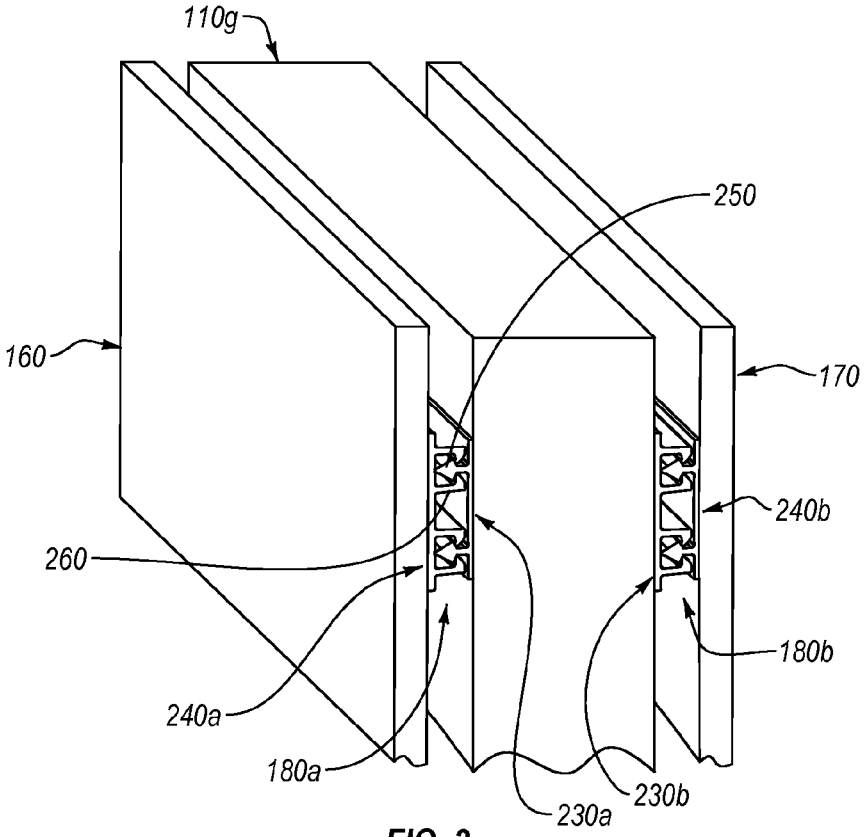
FIG. 3 illustrates a perspective view of a structural wall module in accordance with one implementation of the present invention.

As illustrated in FIGS. 3-6B, in one or more implementations, the structural wall modules can incorporate one or more portions of a quick-connect cladding system to attach one or more cladding layers to the building envelope formed in the form of curtain walls. More specifically, FIG. 3 illustrates a structural wall module 110*g* and interior and exterior cladding layers 160, 170 secured to the structural wall module 110*g* with respective quick-connect assemblies 180*a*, 180*b*. Except as otherwise described herein, the structural wall module 110*g* and its materials, elements, or components can be similar to or the same as any of the structural wall modules 110*a*, 110*b*, 110*c*, 110*d*, 110*e*, 110*f* (FIGS. 1A-2) and their respective materials, elements, and components. In one implementation, the structural wall module 110*g* can include various brackets and/or connectors for connecting the cladding layers 160, 170.

For instance, the structural wall module 110*g* can include wall-side connectors 230*a*, 230*b* secured thereto, as described in more detail below. Similarly, the cladding layers 160, 170 can include receivers or connectors, which can accept or couple to connectors secured to the structural wall module 110*g*. In one example, the cladding layers 160, 170 include cladding-side connectors 240*a*, 240*b*, which can connect to the corresponding wall-side connectors 230*a*, 230*b*.

It should be appreciated that the wall-side connectors 230*a*, 230*b* and the corresponding cladding-side connectors 240*a*, 240*b* can have any number of suitable positions and orientations. FIG. 3 illustrates the wall-side and the cladding-side connectors 230*a*, 230*b*, 240*a*, 240*b* oriented approximately horizontally. In additional or alternative implementations (and as described further below) the wall-side connectors and corresponding cladding-side connectors can have vertical, angled or any number of orientations relative to the wall module and/or relative to a base or foundation.

In one or more implementations, the wall-side connectors 230 can include one or more connection features 250 that can couple with corresponding connection features 260, coupled to or incorporated into the cladding-side connectors 240. The connection features 260, for instance, can include undercutting portions that can secure the connection features 250. Furthermore, the connection features 250 and 260 can have interchangeable profiles.

In addition, as mentioned above, the wall-side and the cladding-side connectors may be interchangeable. In one example, as shown in FIG. 3, wall-side connectors 230*a* may be male-type connectors, while the cladding-side connectors 240*a* may be female-type connectors, which can accept a portion of the male-type wall-side connectors 230*a*. Alternatively, wall-side connectors 230*b* may be female-type connectors that can accept a portion of male-type cladding-side connectors 240*b*. In any event, wall-side and cladding-side connectors can connect and couple together to secure the cladding layers to the structural wall module.

Moreover, the connection features 250 and/or 260 can have any number of suitable configurations that can allow the wall-side and the cladding-side connectors 230*a*, 230*b*, 240*a*, 240*b* to connect together and secure the cladding layers 160, 170 to the structural wall module 110*g*. For example, one of the connection features can have grooves, while another of the connection features can include spring-loaded balls that can fit into such grooves. Connection features also may include barbs and corresponding openings that can secure such barbs. Furthermore, the connection features can have corresponding locking tapers, similar to the locking tapers described above in connection with the matching interlocks 120 (FIG. 3).

In at least one implementation, a manufacturer can supply modular walls at the factory with preinstalled wall-side connectors 230*a*, 230*b*. Then, at the building site, an installer can quickly and easily attach cladding layers 160, 170 to the wall-side connectors 230*a*, 230*b*. One will appreciate that by prefabricating the structural wall modules with wall-side connectors, such as the wall-side connectors 230*a*, 230*b*, the time necessary for constructing the building at the site can be greatly reduced.

In any event, the wall-side and cladding-side connectors 230*a*, 230*b*, 240*a*, 240*b* can allow the builder to snap-in the cladding layers 160, 170 to the structural wall module. Accordingly, the builder can quickly and easily secure the cladding layers 160, 170 to the structural wall module 110*g*. Moreover, locations and orientations of the wall-side connectors 230*a*, 230*b* and the cladding-side connectors 240*a*, 240*b* can force the builder to position and orient the cladding layers 160, 170 at predetermined positions and orientations, which can minimize or eliminate installation mistakes.

As described above, the cladding layer 160 can form an outer surface of the building (e.g., stucco, brick, etc.), which can provide aesthetic properties as well as weatherproofing for the building. Similarly, the cladding layer 170 can form an interior curtain wall on the building's walls (e.g., drywall, decorative tiles, etc.). Hence, by interconnecting structural wall modules and securing the exterior and interior cladding layers to the structural wall modules, the builder can quickly complete and finish the building envelope.

Additional implementations can include structural wall modules and modular walls that can allow the builder the incorporate various utility and/or communication lines. For instance, the wall-side and cladding-side connectors 230*a*, 230*b*, 240*a*, 240*b* can provide space between the structural wall module 110*g* and the cladding layers 160, 170. The space between the structural wall module 110*g* and the cladding layers 160 and/or 170 can accommodate the utility lines and systems. Examples of utility and communication lines include plumbing and sewer lines, HVAC ducts, electrical power lines and outlets, data and other network lines, etc.

Specifically, the builder can incorporate the utility and/or communication lines into the structural wall modules as well as into the modular inner walls, prior to and/or after securing respective cladding layers 160 and/or 170 to the structural wall module 110*g*. Furthermore, the builder can remove the cladding layers 160 and/or 170 or portions thereof from the structural wall module 110*g* to allow inspection of the utility and/or communication lines installed therein. Hence, the modular utility wall system can reduce the time and cost associated with installing utility and communication lines within the building.

Moreover, the space can separate the interior and/or exterior cladding behavior from the modular walls or building envelope. In other words, space can at least partially isolate effects on the interior and/or exterior cladding layers by their respective environments from transmission to the structural wall module. For instance, the spaces can substantially reduce sound transmission, due to the separation of cladding layers from the surface of the structural wall module by the quick-connector assemblies and the mass of the cladding layers.

Figure 4:
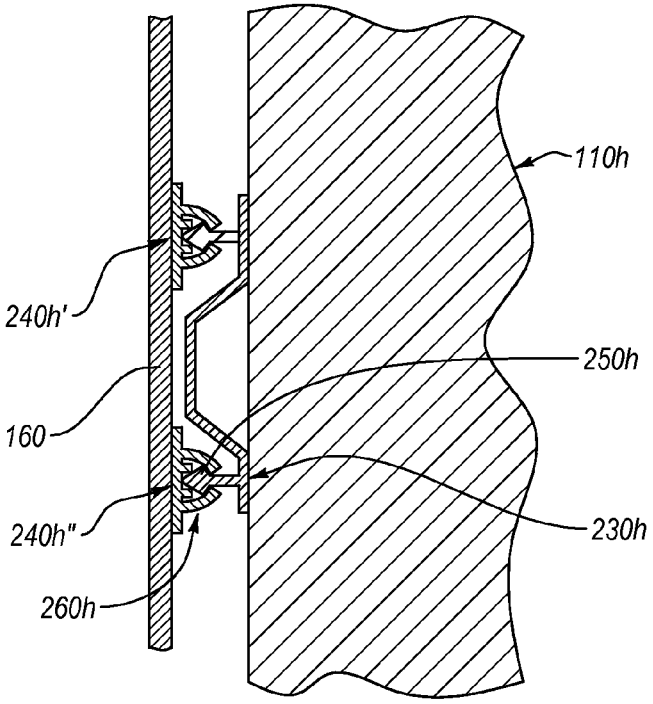
FIG. 4 illustrates a perspective view of a structural wall module in accordance with another implementation of the present invention.

As noted above, the quick-connector assemblies can vary from one implementation to the next. In some instances, a single wall-side and/or cladding-side connector can incorporate multiple connection features. For instance, FIG. 4 illustrates a structural wall module 110*h*, which includes cladding-side connectors 240*h*', 240*h*", each having a single connection feature. Except as otherwise described herein, the structural wall module 110*h* and its materials, elements, or components can be similar to or the same as any of the structural wall modules 110*a*, 110*b*, 110*c*, 110*d*, 110*e*, 110*f*, 110*g* (FIGS. 1A-3) and their respective materials, elements, and components.

The cladding-side connectors 240*h*', 240*h*" can couple to a wall-side connector 230*h*. More specifically, the cladding-side connectors 240*h*', 240*h*" can include respective connecting features 260*h*, which can connect to connecting features 250*h* of the wall-side connector 230*h*. In other words, a single wall-side connector, such as the wall-side connector 230*h*, can connect to multiple cladding-side connectors (e.g., two cladding-side connectors 240*h*', 240*h*") and vice versa. Accordingly, the manufacturer can place any suitable number of cladding-side connectors and/or wall-side connectors, each of which can include any suitable number of connecting features, which may vary from one implementation to another.

Figure 5:
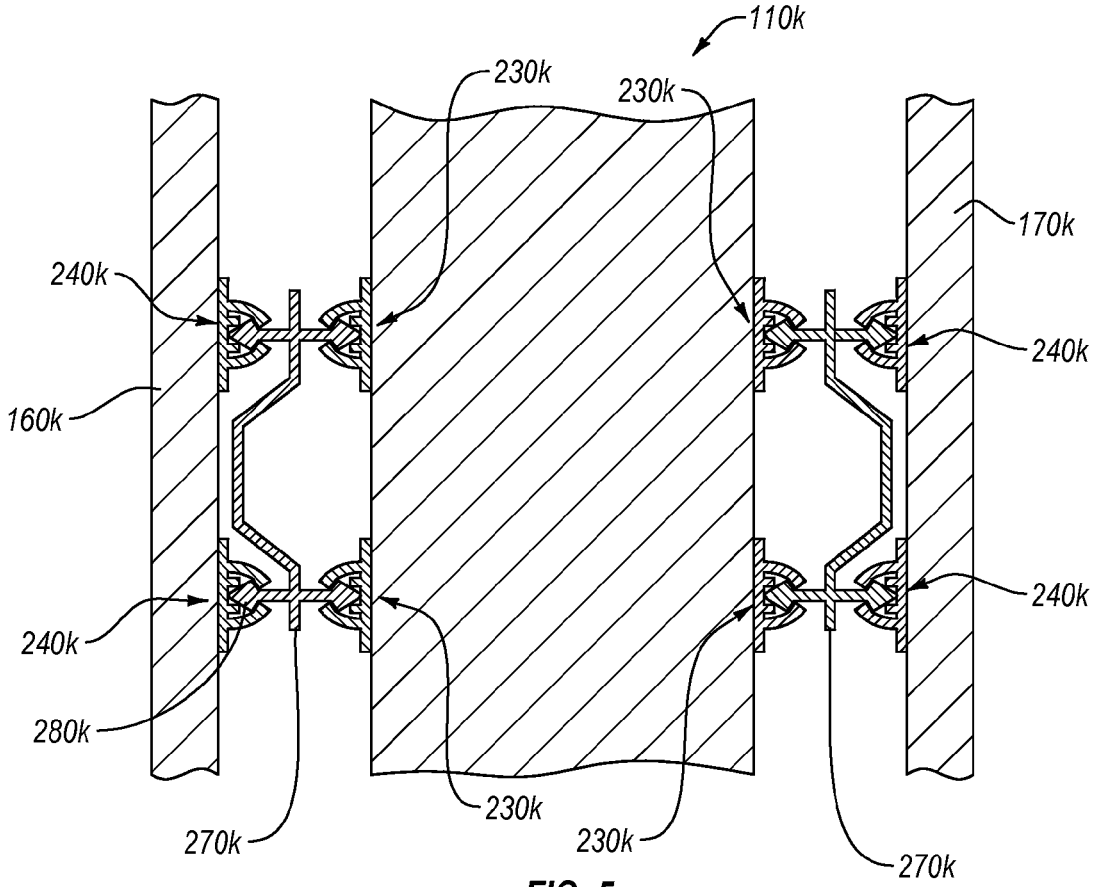
FIG. 5 illustrates a perspective view of a structural wall module in accordance with yet another implementation of the present invention.

As described above, one of the cladding-side or the wall-side connectors may be a female-type connector, while the other, corresponding connector may be a male-type connector. In some implementation, both cladding-side and wall-side connectors may be female-type connectors. For instance, FIG. 5 illustrates a structural wall module 110*k* and cladding layers 160*k*, 170*k* connected thereto. Except as otherwise described herein, the structural wall module 110*k* and its materials, elements, or components can be similar to or the same as any of the structural wall modules 110*a*, 110*b*, 110*c*, 110*d*, 110*e*, 110*f*, 110*g*, 110*h* (FIGS. 1A-4) and their respective materials, elements, and components.

In one implementation, the structural wall module 110*k* includes female-type wall-side connectors 230*k* coupled to female-type cladding-side connectors 240*k*. Particularly, an interconnector 270*k* can couple together the wall-side and the cladding-side connectors 230*k*, 240*k*. In one example, the interconnector 270*k* can include opposing male-type connection features 280*k*, which can connect to the wall-side and cladding-side connectors 230*k*, 240*k*, thereby coupling together the wall-side and cladding-side connectors 230*k*, 240*k*.

In some implementations, the interconnector 270*k* can have directly opposing connection features 280*k*. Accordingly, the builder can align the wall-side and cladding-side connectors 230*k*, 240*k* directly opposite to one another. Alternatively, the connections features on one side of the interconnector 270*k* can be offset relative to the connection features on the opposite side thereof. As such, the interconnector 270*k* can compensate for any misalignment between the cladding layer and the structural wall module as well as can offset the cladding layer relative to the structural wall module.

Figure 6A:
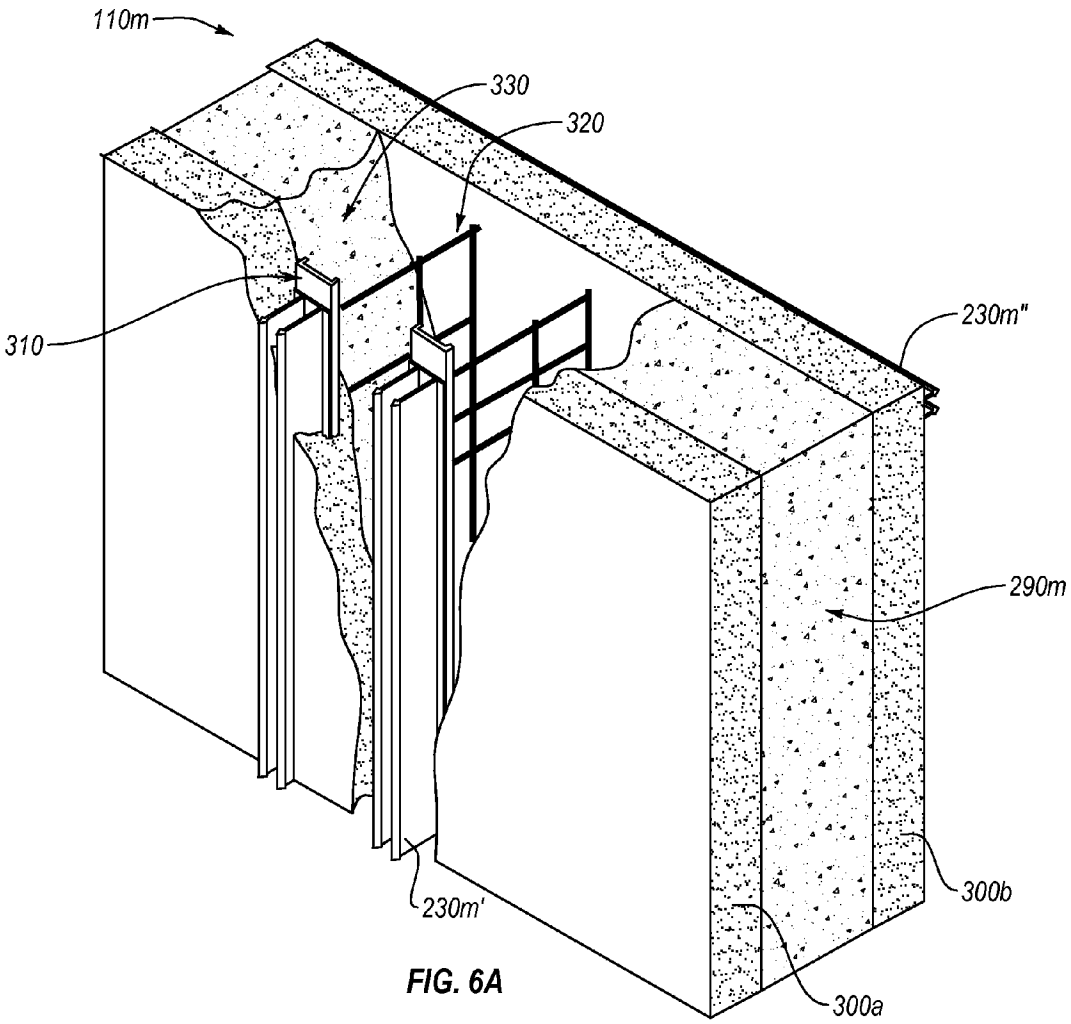
FIG. 6A illustrates a perspective view of an ICF configured structural wall module in accordance with one implementation of the present invention.
Figure 6B:
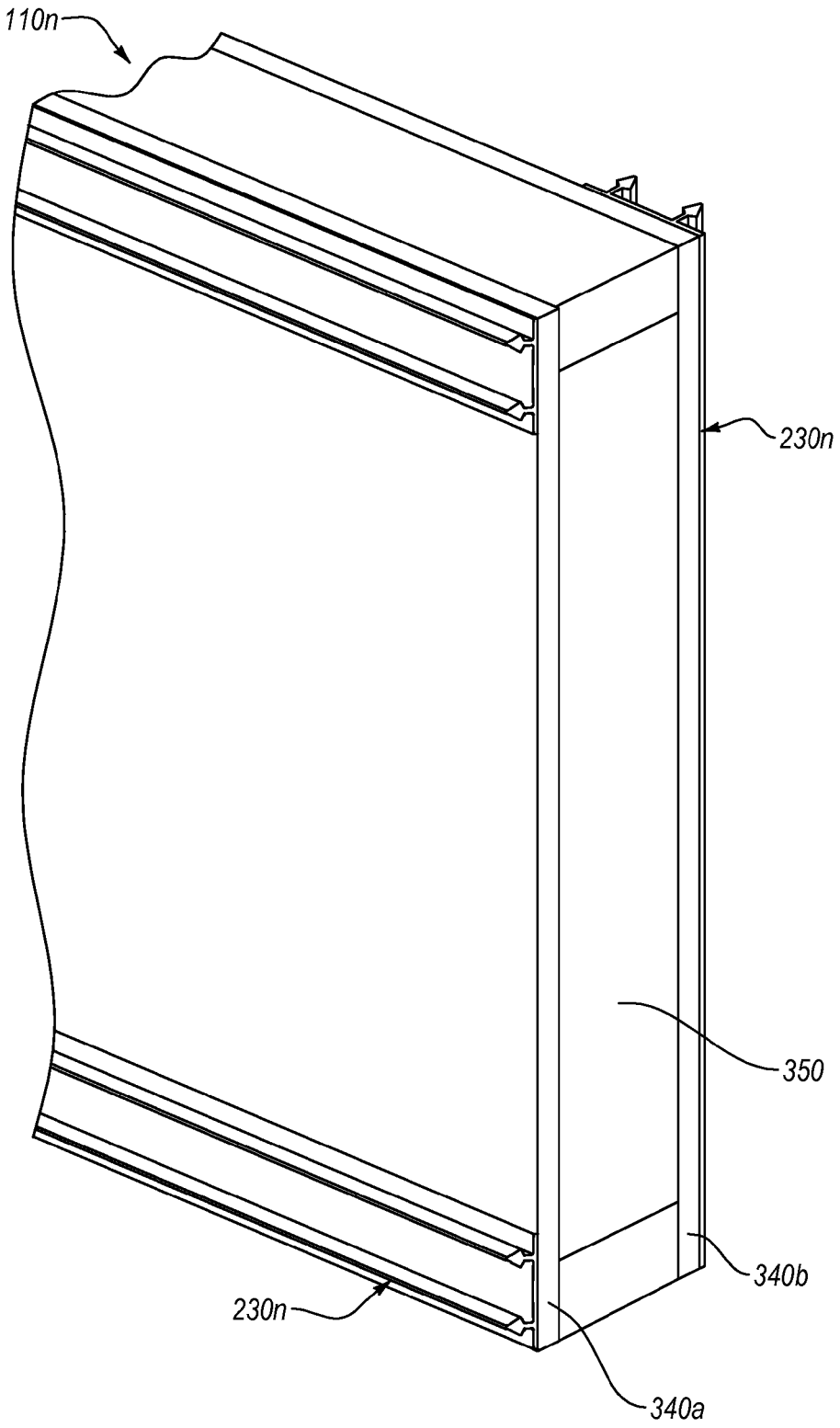
FIG. 6B illustrates a perspective view of a SIP configured structural wall module in accordance with one implementation of the present invention.

Additionally, the cladding layers may connect together to form one or more curtains. Also, interconnected structural wall modules can form structural modular walls that can include curtains on one or both sides thereof. In one or more implementations, the structural wall modules may include SIP or ICF configured wall modules. FIGS. 6A-6B illustrate respective ICF configured and SIP configured structural wall modules 110*m*, 110*n*. Except as otherwise described herein, the structural wall modules 110*m*, 110*n* and their respective materials, elements, or components can be similar to or the same as any of the structural wall modules 110*a*, 110*b*, 110*c*, 110*d*, 110*e*, 110*f*, 110*g*, 110*h*, 110*k* (FIGS. 1A-5) and their respective materials, elements, and components.

For example, as shown in FIG. 6A, the ICF configured structural wall module 110*m* can include a structural inner layer 290*m* surrounded by insulating layers 300*a*, 300*b*. The structural inner layer 290*m* can include supporting webbing 310 and/or reinforcement bars 320 encased in concrete 330. As described above, the wall-side connectors can connect to the structural wall module in any number of suitable locations and configurations.

In one example, wall-side connectors 230*m*', 230*m*" can couple to or can be incorporated into the supporting webbing 310 and/or the reinforcement bars 320 of the ICF configured structural wall module 110*m*. For example, the supporting webbing 310 can comprise thermoplastic material, such as polypropylene, which the manufacturer can mold over the wall-side connectors 230*m*', 230*m*". In one implementation, a portion of the wall-side connectors 230*m*', 230*m*" can enter the structural inner layer 290*m*, such that, for instance, the concrete 330 can encase at least a portion of the wall-side connectors 230*m*', 230*m*".

The wall-side connectors 230*m*', 230*m*" can comprise material that can be the same as or different from the material of the supporting webbing 310. It should be noted that the supporting webbing 310 also can comprise metal, such as steel or aluminum. Thus, the manufacturer can incorporate the wall-side connectors 230*m*', 230*m*" into the support webbing 310 and/or into the reinforcement bars 320, which can comprise the same material (e.g., steel, aluminum, etc.). In any event, the wall-side connectors 230*m*', 230*m*" can attach to the structural wall module 110*m* in any number of suitable configurations, positions, and orientations (e.g., vertical, horizontal, etc.), which can vary from one implementation to another.

FIG. 6B illustrates the SIP configured structural wall module 110*n*, which can have outer supporting layers 340*a*, 340*b* and an inner insulating layer 350. Additionally, in one or more implementations, the structural wall module 110*n* can include wall-side connectors 230*n*. Moreover, the wall-side connectors 230*n* may attach to the structural wall module 110*n* in any number of suitable configurations, positions, and orientations (e.g., vertical, horizontal, etc.), which can vary from one implementation to another.

In one or more implementations, the manufacturer can secure the wall-side connectors 230*n* on and/or to the outer supporting layers 340*a* and/or 340*b* of the structural wall module 110*n*. For instance, the manufacturer can secure the wall-side connectors 230*n* to an outer surface of one or more of the outer supporting layers 340*a*, 340*b*. Additionally or alternatively, the manufacturer can secure wall-side connectors 230*n* on the inner surfaces of one or more outer supporting layers 340*a*, 340*b* (i.e., surfaces facing the inner insulating layer 350). Thus, for example, the connection features of the wall-side connectors 230*n* can protrude through the supporting layers 340*a* and/or 340*b*.

In addition, the building can include one or more modular inner walls, as more fully described in U.S. Pat. No. 8,024,901, entitled "Integrated Reconfigurable Wall System," the entire content of which is incorporated herein by this reference. Accordingly, the builder can incorporate the desired utility and/or communication lines within the modular inner walls of the building, and can avoid incorporating such utility and/or configuration lines within the building envelope.

For instance, the builder can complete installation of the utility and communication lines within the structural wall modules and modular walls and/or within the modular inner walls of the building and can leave one or more of cover tiles unattached to the modular inner wall. Hence, the utility and communication lines can remain partially exposed. Accordingly, the builder can allow access to the installed utility and communication lines for inspection and modifications. Thus, the builder can complete installation of the utility and communication lines on a preset schedule and may not need to work according to a schedule setup by inspectors.

Having the utilities within the interior modular walls can eliminate the need for dealing with utilities in the exterior walls, increasing the speed of construction and eliminating the challenges/time/errors related to such. In addition, the use of modular electrical componentry within modular walls (easily accessible through removable cladding tiles) simplifies the electrical installation and speeds up the electrical installation. Work can be completed irrespective of electrical inspection schedules, as tiles can simply be left off one side of the wall for inspection, or even removed when required for such. Other utilities such as HVAC or plumbing can also be run modularly through the internal walls.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. An interlocking modular wall system for constructing at least a portion of a building, the interlocking modular wall system comprising:

a first structural wall module including a first interlock positioned at an offset from one or more of a vertical centerline or a horizontal centerline of the first structural wall module, wherein:

a first cladding portion attached to a first side of the first structural wall module comprises an external surface of a building, wherein the first cladding portion is attached to the first side of the first structural wall via a double-sided interconnector having first and second directly opposing connecting features, the first directly opposing connecting feature connecting to an interior surface of the building and the second directly opposing connecting feature connecting to an interior surface of the first cladding portion, and a second cladding portion attached to a second side of the first structural wall module comprises an internal surface of the building; and a second structural wall module including a second interlock positioned at an offset from one or more of a vertical centerline or a horizontal centerline of the second structural wall module, wherein:

the first interlock is connectable with the second interlock;

when connected together, the first and second interlocks orient and position the first structural wall module relative to the second structural wall module in a specified position;

the first and second interlocks are positioned at different offset distances from a top and bottom of the structural wall modules, such that alternate orientations of the first and second structural wall modules are prevented;

a third cladding portion attached to a first side of the second structural wall module comprises another external surface of the building, and a fourth cladding portion attached to a second side of the second structural wall module comprises another internal surface of the building.

2. The interlocking modular wall system as recited in claim 1, wherein:

one or more of the first structural wall module and the second structural wall module includes one or more openings sized and configured for a door or a window; and when connected together, the first and second interlocks orient and position the one or more openings at predetermined positions and orientations.

3. The interlocking modular wall system as recited in claim 1, further comprising:

a third structural wall module including a third interlock positioned at an offset from one or more of a vertical centerline or a horizontal centerline of the third structural wall module, wherein the first structural wall module includes a fourth interlock positioned at an offset from one or more of the vertical centerline or the horizontal centerline of the first structural wall module, the fourth interlock being connectable with the third interlock and having a different offset from one or more of the vertical centerline or the horizontal centerline than the first interlock.

4. The interlocking modular wall system as recited in claim 1, wherein the first interlock is a female interlock and the second interlock is a male interlock sized and configured to at least partially enter the female interlock.

5. The interlocking modular wall system as recited in claim 4, wherein the male interlock and the female interlock have corresponding snap-fit connections.

6. The interlocking modular wall system as recited in claim 1, wherein the first interlock is a female interlock and the second interlock is a female interlock, and the interlocking wall system includes a dowel sized and configured to fit within the first and second interlocks.

7. The interlocking modular wall system as recited in claim 1, wherein one or more of the first and second structural wall modules comprise a SIP configured wall module.

8. An interlocking modular wall system for constructing a building, the interlocking modular wall system comprising:

a first structural wall module including one or more first interlocking features and one or more first wall-side connectors, wherein:

a first side of the first structural wall module comprises an exterior surface of the building to which a first cladding is attachable, wherein the first cladding is attached to the first side of the first structural wall via a double-sided interconnector having first and second directly opposing connecting features, the first directly opposing connecting feature connecting to an interior surface of the building and the second directly opposing connecting feature connecting to an interior surface of the first cladding, and a second side of the first structural wall module comprises an interior surface of the building to which a second cladding is attachable; a second structural wall module including one or more second interlocking features and one or more second wall-side connectors, the one or more second interlocking features being connectable to the one or more first interlocking features, the first and second interlocking features being configured to orient and position the first structural wall module relative to the second structural wall module in a specified position, the first and second interlocking features being positioned at different offset distances from a top and bottom of the structural wall modules, such that alternate orientations of the first and second structural wall modules are prevented, wherein the first structural wall module is separate from the second structural wall module; and one or more cladding layers including cladding-side connectors secured thereto or integrated therewith, wherein:

the cladding-side connectors are connectable to one or more of the one or more first wall-side connectors and the one or more second wall side connectors.

9. The interlocking modular wall system as recited in claim 8, wherein a first cladding layer of the one or more cladding layers is connected to an exterior side of one or more of the first structural wall module and the second structural wall module.

10. The interlocking modular wall system as recited in claim 8, wherein the cladding-side connectors and the one or more first and second wall-side connectors form a space between the cladding layer and the first and second structural wall modules.

11. The interlocking modular wall system as recited in claim 10, further comprising one or more utility lines or communication lines located in the space between the cladding layer and one or more of the first and second structural wall modules.

12. An interlocking modular wall system for constructing at least a portion of a building, the interlocking modular wall system comprising:

a first structural wall module including a first interlock positioned at an offset from one or more of a vertical centerline or a horizontal centerline of the first structural wall module, wherein:

a first cladding portion attached to a first side of the first structural wall module comprises an external surface of a building, wherein the first cladding portion is attached to the first side of the first structural wall via a double-sided interconnector having first and second directly opposing connecting features, the first directly opposing connecting feature connecting to an interior surface of the building and the second directly opposing connecting feature connecting to an interior surface of the first cladding portion, and a second cladding portion attached to a second side of the first structural wall module comprises an internal surface of the building;

a second structural wall module including a second interlock positioned at an offset from one or more of a vertical centerline or a horizontal centerline of the second structural wall module, wherein:

the first interlock is connectable with the second interlock;

when connected together, the first and second interlocks orient and position the first structural wall module relative to the second structural wall module in a specified position;

the first and second interlocks are positioned at different offset distances from a top and bottom of the structural wall modules, such that alternate orientations of the first and second structural wall modules are prevented;

a third cladding portion attached to a first side of the second structural wall module comprises another external surface of the building, and a fourth cladding portion attached to a second side of the second structural wall module comprises another internal surface of the building; and a third structural wall module including a third interlock positioned at an offset from one or more of a vertical centerline or a horizontal centerline of the third structural wall module, wherein the first structural wall module includes a fourth interlock positioned at an offset from one or more of the vertical centerline or the horizontal centerline of the first structural wall module, the fourth interlock being connectable with the third interlock and having a different offset from one or more of the vertical centerline or the horizontal centerline than the first interlock.

13. The interlocking modular wall system as recited in claim 12, wherein:

one or more of the first structural wall module, the second structural wall module and the third structural wall module includes one or more openings sized and configured for a door or a window; and when connected together, the first, second and third interlocks orient and position the one or more openings at predetermined positions and orientations.

14. The interlocking modular wall system as recited in claim 12, wherein the first interlock is a female interlock and the second interlock is a male interlock sized and configured to at least partially enter the female interlock.

15. The interlocking modular wall system as recited in claim 14, wherein the male interlock and the female interlock have corresponding snap-fit connections.

16. The interlocking modular wall system as recited in claim 12, wherein the first interlock is a female interlock and the second interlock is a female interlock, and the interlocking wall system includes a dowel sized and configured to fit within the first and second interlocks.

17. The interlocking modular wall system as recited in claim 12, wherein one or more of the first and second structural wall modules comprise a SIP configured wall module.

18. The interlocking modular wall system as recited in claim 12, further comprising one or more cladding layers, wherein a first cladding layer of the one or more cladding layers is connected to an exterior side of one or more of the first structural wall module, the second structural wall module or the third structural wall module.

19. The interlocking modular wall system as recited in claim 18, wherein the one or more cladding layers include cladding-side connectors secured thereto or integrated therewith, the cladding-side connectors and one or more first and second wall-side connectors forming a space between the cladding layer and the first, second or third structural wall modules.

20. The interlocking modular wall system as recited in claim 19, further comprising one or more utility lines or communication lines located in the space between the cladding layer and one or more of the first, second or third structural wall modules.

* * * * *